US007618279B1

(12) United States Patent
Osborn, Jr. et al.

(10) Patent No.: US 7,618,279 B1
(45) Date of Patent: Nov. 17, 2009

(54) ONE-PIECE PUSH-IN ELECTRICAL CONTACT TERMINAL

(75) Inventors: Robert Hill Osborn, Jr., Somerville, TN (US); Andrew Christopher Cole, Memphis, TN (US); James Michael Baker, Southaven, MS (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 12/146,691

(22) Filed: Jun. 26, 2008

(51) Int. Cl.
*H01R 4/26* (2006.01)

(52) U.S. Cl. ..... 439/441; 439/858

(58) Field of Classification Search ..... 439/441, 439/858, 862, 395–401, 860, 861
See application file for complete search history.

(56) References Cited

U.S. PATENT DOCUMENTS

| | | | | |
|---|---|---|---|---|
| 3,646,582 | A | 2/1972 | Van Alphen et al. | |
| 3,688,243 | A | 8/1972 | Yamada et al. | |
| 3,914,004 | A * | 10/1975 | Bone | 439/393 |
| 3,977,751 | A | 8/1976 | Sahrbacker | |
| 4,036,545 | A | 7/1977 | Mysiak et al. | |
| 4,350,839 | A * | 9/1982 | Lass | 174/661 |
| 4,455,057 | A * | 6/1984 | Mariani | 439/424 |
| 4,461,527 | A | 7/1984 | Izraeli | |
| 4,566,748 | A | 1/1986 | Tanishi et al. | |
| 4,566,749 | A | 1/1986 | Johnston | |
| 4,585,902 | A | 4/1986 | Munroe | |
| 4,673,232 | A | 6/1987 | Kubota et al. | |
| 4,838,816 | A * | 6/1989 | Matsusaka et al. | 439/861 |
| 4,918,258 | A | 4/1990 | Ayer | |
| 5,019,674 | A | 5/1991 | Greene | |
| 5,149,279 | A | 9/1992 | Kruse | |
| 5,292,260 | A | 3/1994 | Sinisi et al. | |
| 5,454,730 | A | 10/1995 | Tozuka | |
| 5,519,171 | A | 5/1996 | Vester | |
| 5,529,522 | A | 6/1996 | Huang | |
| 5,626,488 | A | 5/1997 | Albeck et al. | |
| 5,760,332 | A | 6/1998 | Rocci et al. | |
| 6,086,433 | A * | 7/2000 | Hils et al. | 439/849 |
| 6,257,919 | B1 | 7/2001 | Cutler et al. | |
| 6,280,233 | B1 | 8/2001 | Beege et al. | |
| 6,315,597 | B1 * | 11/2001 | Coyne et al. | 439/436 |
| 6,814,608 | B2 | 11/2004 | Kollmann | |
| 6,872,104 | B2 * | 3/2005 | Sun | 439/862 |
| 6,890,192 | B2 | 5/2005 | Riku | |
| 6,893,286 | B2 | 5/2005 | Drewes et al. | |
| 6,969,271 | B2 * | 11/2005 | Hernandez et al. | 439/397 |
| 6,981,890 | B2 | 1/2006 | Cutler et al. | |
| 7,083,463 | B2 | 8/2006 | Steinkemper et al. | |
| 7,086,912 | B2 * | 8/2006 | Matsuura et al. | 439/845 |
| 7,118,429 | B1 | 10/2006 | Fabian | |
| 7,131,857 | B2 | 11/2006 | Mueller | |
| 7,175,469 | B1 * | 2/2007 | Daily et al. | 439/441 |
| 7,225,592 | B2 | 8/2007 | Tseng | |
| D550,625 | S | 9/2007 | Osborn, Jr. et al. | |
| D550,626 | S | 9/2007 | Osborn, Jr. et al. | |
| 2007/0091596 | A1 | 4/2007 | Grossman et al. | |
| 2007/0249215 | A1 * | 10/2007 | Osborn et al. | 439/441 |

* cited by examiner

*Primary Examiner*—Hae Moon Hyeon
*Assistant Examiner*—Harshad C Patel
(74) *Attorney, Agent, or Firm*—Hoffman & Baron, LLP

(57) ABSTRACT

An electrical contact terminal for an electrical connector generally includes a main contact body, a cantilevered portion extending upwardly from one end of the body and a stiffener extending the entire length of the main contact body for providing rigidity to the main contact body.

24 Claims, 2 Drawing Sheets

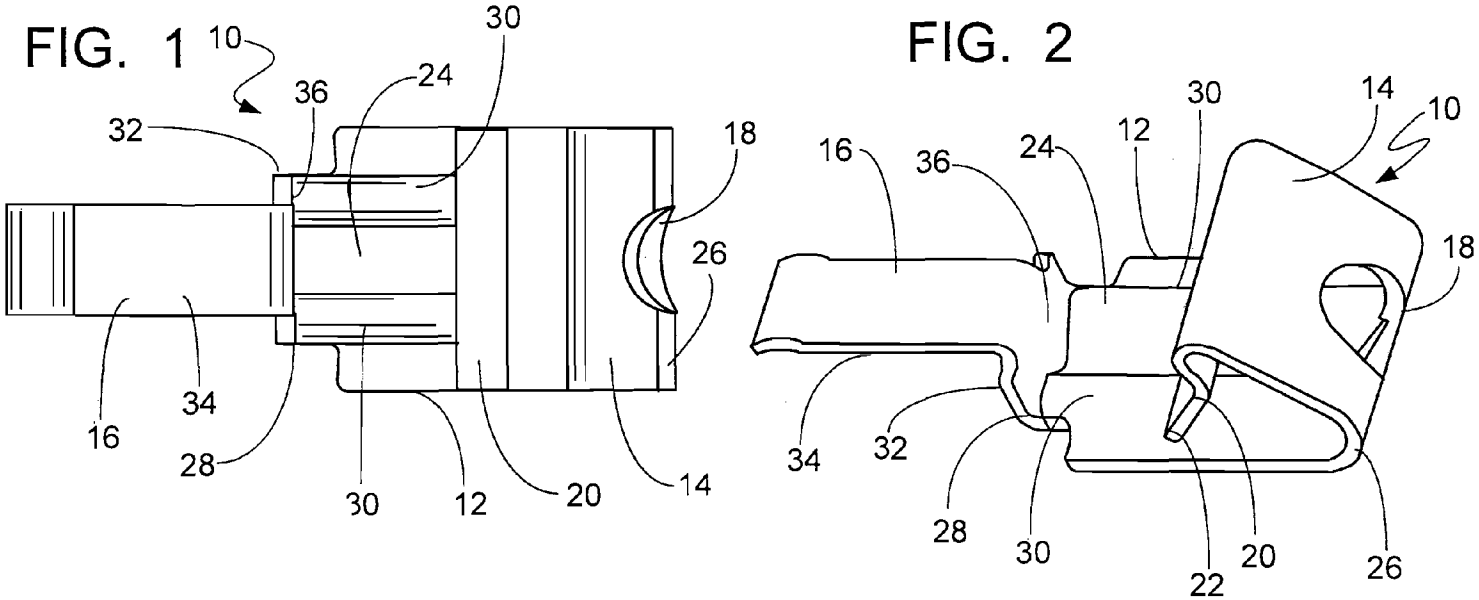
FIG. 2
FIG. 1
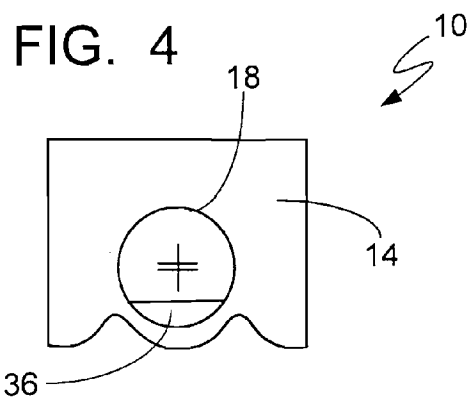
FIG. 4
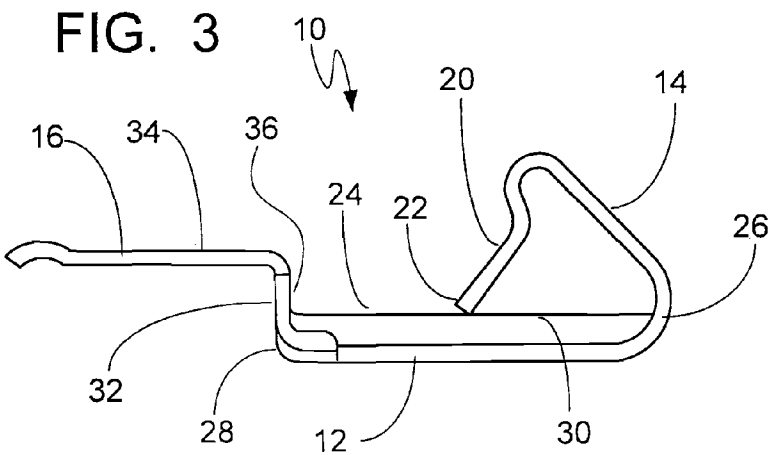
FIG. 3

ONE-PIECE PUSH-IN ELECTRICAL CONTACT TERMINAL

BACKGROUND OF THE INVENTION

The present invention relates generally to electrical connector components and more particularly to a one-piece push-in electrical contact terminal, designed to accept both stripped solid and stranded wire, which provides a means for mechanically and electrically terminating the wire.

Industry standards are oftentimes established as a means of insuring the safety of the installer and for the end-user. For example, the National Electric Code (NEC) has implemented regulations requiring all fluorescent lighting fixtures to have a means of electrically isolating their components so as to increase the safety of working on them or replacing their parts in the field. This new provision is intended to standardize the ability to safely disconnect various electrical components from both a power source as well as a ground or neutral wiring. This requirement is expected to apply particularly to fluorescent tube lamps and their associated ballasts.

As can be appreciated, there are many different types of electrical connectors for use in such fluorescent fixtures that are capable of being easily connected and disconnected. In particular, they are all quite capable of safely de-energizing or removing an electrical component from a circuit (power or ground) so that it may be serviced in confidence. Of course, while proper technique tries to avoid pulling of the wires to separate the connector, in practice, this may be exactly what actually occurs. Pulling directly on the wires instead of the connector is likely to weaken the connection between the wire and the electrical contact within the connector. In some cases, the wire is soldered or crimped to the contact, in other cases the wire is simply inserted into an insulation displacement contact or pushed into the connector. Such mishandling (i.e. pulling on the wires instead of the connector) can cause these joints to separate, the consequence being the separation of the wire from the contact terminal thereby rendering the connector unusable.

It is, therefore, desirable to provide an electrical contact for use in a separable electrical connector with structural features to enhance retaining of the wires to the contact even under conditions of repeated mishandling. It is further desirable to provide a new contact terminal design that is better at resisting such mishandling and which can be repeatedly used to safely break or disrupt the electric circuit to a component being replaced or serviced. It is still further desirable to provide an electrical contact that can withstand repeated disconnections and re-connections by various workers without affecting its ability to provide a low resistance electrical connection.

SUMMARY OF THE INVENTION

The present invention is an electrical contact terminal for an electrical connector, which generally includes a main contact body, a cantilevered portion extending upwardly from one end of the body and a stiffener extending the entire length of the main contact body for providing rigidity to the main contact body.

In a preferred embodiment, the stiffener comprises two substantially parallel ribs disposed on the body. The ribs are preferably laterally spaced a distance equal to a diameter of a conductor of the wire received by the cantilevered portion, whereby the ribs are configured to receive the conductor therebetween. Also, the cantilevered portion preferably includes a wire opening formed therethrough, wherein the ribs are disposed on opposite sides of the wire opening.

The contact terminal of the present invention further preferably includes a tongue member extending outwardly from an end of the main contact body opposite the cantilevered portion. Specifically, the cantilevered portion extends from the main contact body at a junction thereof and the tongue member extends from the main contact body at a junction thereof. The stiffener thus extends from the cantilevered portion juncture to the tongue member juncture.

The tongue member preferably includes a step portion extending upwardly from the opposite end of the main contact body and a tongue portion connected to the step portion in such a manner that the tongue portion is laterally spaced and substantially parallel with the main contact body. Moreover, the step portion preferably includes a wall surface facing the cantilevered portion for stopping further insertion of a wire in the cantilevered portion.

The present invention further involves an electrical connector that generally includes a contact terminal and a housing defining a chamber for containing the contact terminal. The contact terminal includes a main contact body, a cantilevered portion extending upwardly from one end of the main contact body and a stiffener extending the entire length of the main contact body for providing rigidity to the main contact body. The cantilevered portion is configured to receive a wire inserted therein in an insertion direction and the housing includes an internal ledge adjacent the chamber for preventing the cantilevered portion of the contact form bending in a direction opposite the wire insertion direction.

A preferred form of the electrical contact, as well as other embodiments, objects, features and advantages of this invention, will be apparent from the following detailed description of illustrative embodiments thereof, which is to be read in conjunction with the accompanying drawings.

BRIEF DESCRIPTION OF THE DRAWINGS

FIG. 1 is a top plan view of a push-in contact terminal formed in accordance with the present invention.

FIG. 2 is a top perspective view of the contact terminal shown in FIG. 1.

FIG. 3 is a side plan view of the contact terminal shown in FIG. 1.

FIG. 4 is a front plan view of the contact terminal shown in FIG. 1.

DETAILED DESCRIPTION OF PREFERRED EMBODIMENT

Figure 5:
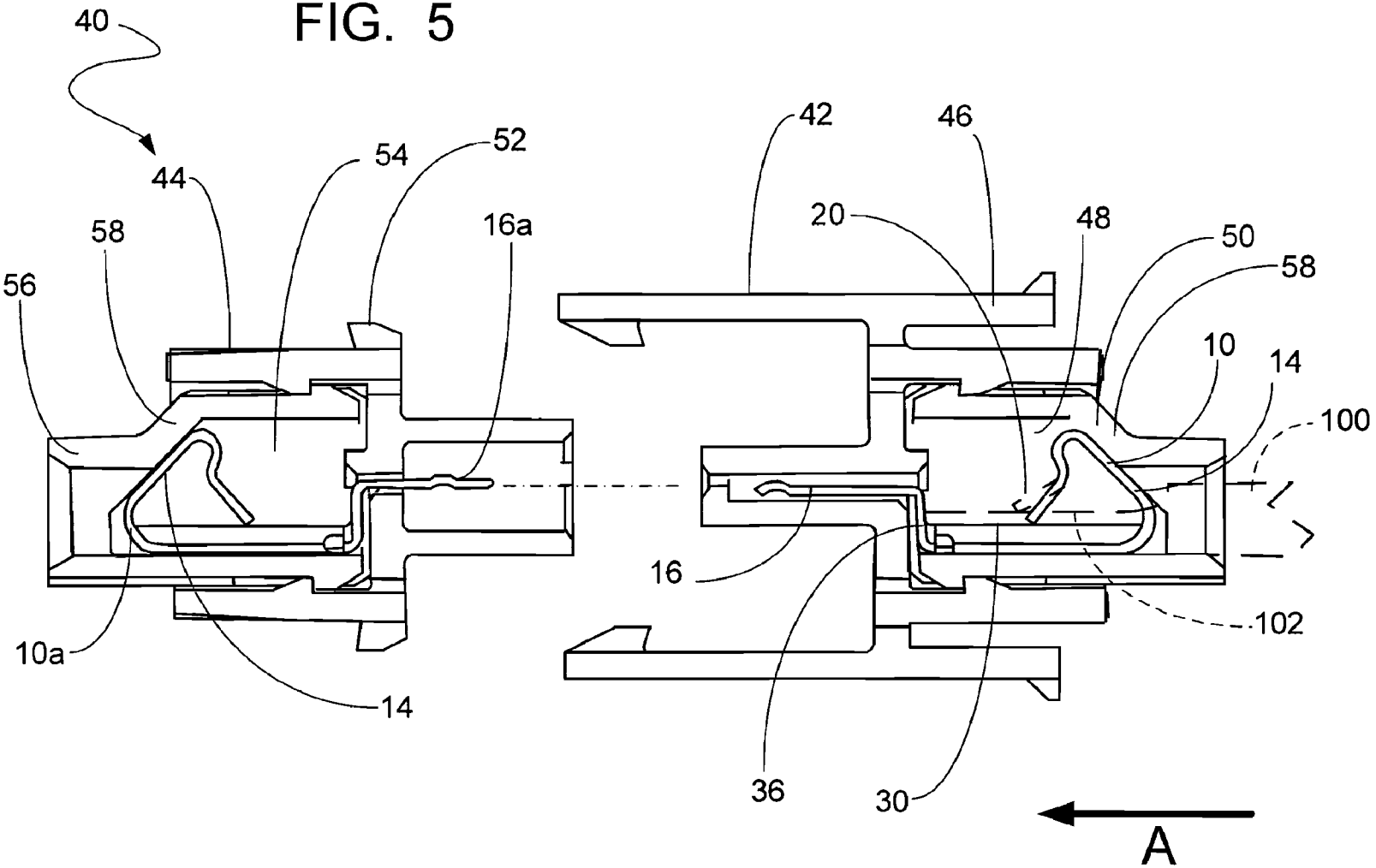
FIG. 5 is a cross-sectional view of a separable connector employing two contact terminals of the present invention.

An electrical contact terminal 10 of the present invention is shown in FIGS. 1-4. These contact terminals are of the "push-in" variety and are often used in such electrical connectors as disconnects. The contact terminal 10 is generally manufactured from a single piece of electrically conductive material. Such contact terminals are generally punched out from a larger sheet of material and then are rolled or bent or otherwise configured into the desired shape. It may be appreciated, however, that multi-component terminals may be employed in the present invention.

The contact terminal of the present invention generally includes a main body 12, a cantilevered portion 14 extending upwardly from one end of the body and a tongue member 16 extending outwardly from the opposite end of the body. The cantilevered portion 14 extends upwardly from the body 12 at a reverse acute angle with respect to the planar body. The cantilevered portion includes a wire opening 18 into which a center conductor 102 of a wire 100 would be pushed or inserted as shown in FIG. 5. Cantilevered portion 14 may also include some type of insulation displacement push-in device (not shown) that is used instead of wire opening 18 if that design is so desired. Such featured device is disclosed in the U.S. Pat. No. 4,455,057 to Mariani and the U.S. Pat. No. 4,461,527 to Izraeli, both of which are incorporated herein by reference.

The cantilevered portion 14 is further preferably configured with a reverse-bent retention finger 20 that extends back towards main body 12. This reverse-bent retention finger 20 retains the wire 100 in compressive engagement against electrical contact terminal 10 in the normal fashion after such wire is pushed through opening 18, as shown in FIG. 5. The retention finger 20 preferably terminates at a sharp distal edge 22 for "digging-into" the center conductor 102 of the wire 100. However, the end 22 of the retention finger 20 can take many different configurations for grasping the wire 100.

As a withdrawal force is applied to the wire 100 in a direction opposite to the wire insertion direction, as shown by the arrow A shown in FIG. 5, the angled bend between cantilevered portion 14 and the main body 12 will be flexed. Any such flexing of the body 12 will increase the angle of this bend thereby significantly altering the angle at which reverse bent retention finger 20 engages the wire. Any slight variation of this angle may permit the wire to undesirably separate from electrical contact terminal 10.

The present invention therefore incorporates a stiffener 24 in the body 12 extending between the juncture 26 of the cantilevered portion 14 with the body rearwardly to the juncture 28 of the tongue member 16 with the body. Thus, the stiffener 24 extends the entire length of the body 12.

The stiffener 24, in the preferred embodiment of the present invention, takes the form of two parallel ribs 30 extending between the juncture 26 of the cantilevered portion 14 with the body rearwardly to the juncture 28 of the tongue member 16 with the body. For reasons that will be explained in further detail below, the ribs 30 are preferably spaced laterally from each other a distance matching the diameter of the center conductor 102 of the wire 100 and are positioned on opposite sides of the wire opening 18. The ribs 30 are preferably stamped or embossed portions of the body 12 formed during the stamping and bending process for manufacturing the contact 10. Alternatively, it is possible to add additional material to the body 12 to form the two ribs 30 extending the length of the body to make the body more rigid and less likely to deflect or deform.

Since the ribs 30 extend into the juncture 26 of the cantilevered portion 14 with the body 12, the ribs prevent the body from flexing or bending during a wire pull-out load. Thus, the body 10 is now strengthened or stiffened and less likely to flex or bend under a wire pull-out load. On the other hand, the cantilevered portion 14 is permitted to flex so that the retention finger 20 will sufficiently grasp the center conductor 102 of the wire 100 as described above. As a result, the wire 100 is more securely mechanically attached to the electrical contact terminal 10. This will ensure that the wire 100 remains attached to the contact terminal 10 during repeated connections and disconnections and especially if the wire is connected to the contact terminal via the method of attachment shown here that employs reverse bent retention finger 20.

Moreover, the stiffening ribs 30 form a valley or trough that functions as a wire guide for receiving the center conductor 102 of the wire 100. As shown in FIG. 5, the ribs 30 extend along and on opposite sides of the center conductor 102 of the wire 100 that is pushed or inserted through the wire opening 18 of the contact 10. These ribs 30 help to channel and retain the center conductor 102 of the wire 100 under the retention finger 20, and thus in electrical and mechanical engagement with the contact 10. The wire opening 18 and the spacing between the ribs 30 can be chosen to accept a variety of different wire gauges, but it is expected that the wire opening 18 would typically be designed to receive smaller wires, such as a wire ranging between 12-18 gauges.

As described above, the tongue member 16 extends outwardly from the end of the body 12 opposite the cantilevered portion 14. The tongue member 16 preferably includes a step portion 32 and a tongue portion 34. The step portion 32 extends upwardly from the juncture 28 of the tongue member 16 with the body 12 and the tongue portion 34 is connected to the step portion so that the tongue portion extends generally parallel, but laterally spaced from the plane of the body 12. This offset arrangement provides added stiffness to the body 12.

In this manner, the wall surface 36 of the step portion 32 facing the wiring opening 18 of the cantilevered portion 14 forms a wire stop for the center conductor 102 of the wire 100 inserted into the contact 10. Specifically, the step portion 32 of the tongue member 16 is spaced from the wire opening 18 of the cantilevered portion 14 a distance equal to a standard length of the center conductor 102 bared during wire preparation. For example, where it is standard practice to strip the outer insulation from wires a distance of three-eighths (3/8) inch for a given connector installation, the step portion 32 for the contact 10 used in the connector of this installation would be spaced three-eighths (3/8) inch from the wire opening 18 of the cantilevered portion 14. The wire stop 36 provides a positive bank stop for proper insertion of the wire 100 into the contact 10 and prevents the wire from being inserted too far into the contact.

FIG. 5 shows the contact 10 in use in a typical connector assembly 40 including a female connector 42 adapted to connect with a male connector 44. The female connector 42 includes a housing 46 defining a chamber 48 for receiving the contact 10 of the present invention therein. The housing 46 is typically made from an insulative material, such as polycarbonate or nylon or another insulating material. A retaining member 50 may be provided to retain the contact 10 within the chamber 48 of the housing 46.

Similarly, the male connector 44 includes an insulative housing 52 defining a chamber 54 for receiving the contact 10*a* of the present invention therein. Again, a retaining member 56 may be provided to retain the contact 10*a* within the chamber 54 of the housing 52. In this case, however, the contact 10*a* includes a tongue member 16*a* adapted to mate with the tongue member 16 of the contact 10 provided in the female connector 42.

Although the drawings show the mating tongue members 16, 16*a* in a spade configuration, any push-in style mating contact design known in the art can be utilized including, but not limited to, ring, fork, sleeve, ferrule, quick disconnect or pin type contact style terminals. Alternate electrical connector component designs are also possible or such components may be employed in other types of electrical connectors such as an interconnect or a splice that is used to join a wire or cable to another or to an electrical device. Thus, the present invention is not limited to the type of electrical connector employed.

The retaining members 50, 56 of the female and male connectors 42, 44 each preferably include an integral angled ledge 58 to contact and confine the cantilevered portion 14 of the contact 10, 10*a*. Thus, as the wire 100 outside the connector 42, 44 is mishandled and tugged backward in a negative direction, the external load also pulls the cantilevered portion 14 as well. However, because the ledge 58 obstructs the cantilevered portion 14 from being pulled back, the wire retention finger 20 flexes, enabling the finger to bear down on the wire to grasp it even more firmly.

Only one contact 10, 10*a* is shown in the connectors 42, 44 of FIG. 5. However, it can be appreciated that these connectors 42, 44 may contain a plurality of mating contacts 10, 10*a* of the present invention. Moreover, while a male-female disconnect system is shown, it is also conceivable to supply one end of the disconnect interface with integral leads for termination directly to a ballast or for wiring into the ballast leads.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

Various changes to the foregoing described and shown structures will now be evident to those skilled in the art. Accordingly, the particularly disclosed scope of the invention is set forth in the following claims.

What is claimed is:

1. A contact terminal for an electrical connector comprising:

a main contact body having an upper surface;

a cantilevered portion extending upwardly from one end of said upper surface of said body, said cantilevered portion configured to receive a wire for electrical connection to the contact terminal; and a stiffener disposed on said upper surface of said main contact body and extending the entire length of said main contact body upper surface, said stiffener providing rigidity to said main contact body.

2. A contact terminal as defined in claim 1, wherein said stiffener comprises two substantially parallel ribs disposed on said body.

3. A contact terminal as defined in claim 1, further comprising a tongue member extending outwardly from an end of said main contact body opposite said cantilevered portion.

4. A contact terminal as defined in claim 3, wherein said cantilevered portion extends from said main contact body at a junction thereof, said junction comprising an internal corner formed by said upper surface of said main contact body and said cantilevered portion, and wherein said tongue member extends from said main contact body at a junction thereof, said stiffener extending from said internal corner of said cantilevered portion juncture to said tongue member juncture.

5. A contact terminal as defined in claim 4, wherein said stiffener comprises two substantially parallel ribs extending from said cantilevered portion juncture to said tongue member junction.

6. A contact terminal as defined in claim 5, wherein said ribs are laterally spaced a distance equal to a diameter of a conductor of the wire received by the cantilevered portion, whereby said ribs are configured to receive the conductor therebetween.

7. A contact terminal as defined in claim 6, wherein said cantilevered portion includes a wire opening formed therethrough, said ribs being disposed on opposite sides of said wire opening.

8. A contact terminal as defined in claim 3, wherein said tongue member comprises:

a step portion extending upwardly from said opposite end of said upper surface of said main contact body; and a tongue portion connected to said step portion, said tongue portion being laterally spaced and substantially parallel with said main contact body.

9. A contact terminal as defined in claim 8, wherein said step portion comprises a wall surface facing said cantilevered portion for stopping further insertion of said wire in said cantilevered portion.

10. A contact terminal as defined in claim 8, wherein said cantilevered portion extends from said main contact body at a junction thereof, said cantilevered portion junction comprising an internal corner formed by said upper surface of said main contact body and said cantilevered portion, and wherein and said step portion extends from said main contact body at a junction thereof, said step portion junction comprising an internal corner formed by said upper surface of said main contact body and said step portion, said stiffener extending from said internal corner of said cantilevered portion juncture to said internal corner of said step portion juncture.

11. A contact terminal as defined in claim 1, further comprising:

a step portion extending upwardly from an end of said body opposite said cantilevered portion, said step portion being spaced away from said cantilevered portion a distance equal to a length of a stripped conductor of the wire received by the cantilevered portion; and a tongue portion connected to said step portion, said tongue portion being laterally spaced and substantially parallel with said main contact body.

12. A contact terminal as defined in claim 11, wherein said step portion comprises a wall surface facing said cantilevered portion for stopping further insertion of a wire in said cantilevered portion.

13. A contact terminal as defined in claim 11, wherein said stiffener comprises two substantially parallel ribs disposed on said body.

14. A contact terminal as defined in claim 11, wherein said cantilevered portion extends from said main contact body at a junction thereof and said step portion extends from said main contact body at a junction thereof, said stiffener extending from said cantilevered portion juncture to said step portion juncture.

15. A contact terminal as defined in claim 14, wherein said stiffener comprises two substantially parallel ribs extending from said cantilevered portion juncture to said step portion junction.

16. A contact terminal for an electrical connector comprising:

a main contact body;

a cantilevered portion extending upwardly from one end of said body, said cantilevered portion configured to receive a wire for electrical connection to the contact terminal; and a stiffener extending the entire length of said main contact body, said stiffener providing rigidity to said main contact body, wherein said stiffener comprises two substantially parallel ribs disposed on said body, and wherein said ribs are laterally spaced a distance equal to a diameter of a conductor of the wire received by the cantilevered portion, whereby said ribs are configured to receive the conductor therebetween.

17. A contact terminal as defined in claim 16, wherein said cantilevered portion includes a wire opening formed therethrough, said ribs being disposed on opposite sides of said wire opening.

18. A contact terminal as defined in claim 16, further comprising a tongue member extending outwardly from an end of said main contact body opposite said cantilevered portion.

19. A contact terminal as defined in claim 18, wherein said cantilevered portion extends from said main contact body at a junction thereof and said tongue member extends from said main contact body at a junction thereof, said stiffener extending from said cantilevered portion juncture to said tongue member juncture.

20. A contact terminal for an electrical connector comprising:

a main contact body;

a cantilevered portion extending upwardly from one end of said body, said cantilevered portion configured to receive a wire for electrical connection to the contact terminal;

a step portion extending upwardly from an end of said body opposite said cantilevered portion;

a tongue portion connected to said step portion, said tongue portion being laterally spaced and substantially parallel with said main contact body; and a stiffener extending the entire length of said main contact body for providing rigidity to said body, wherein said stiffener comprises two substantially parallel ribs disposed on said body, and wherein said ribs are laterally spaced a distance equal to a diameter of a conductor of the wire received by the cantilevered portion, whereby said ribs are configured to receive the conductor therebetween.

21. A contact terminal as defined in claim 20, wherein said cantilevered portion includes a wire opening formed therethrough, said ribs being disposed on opposite sides of said wire opening.

22. A contact terminal for an electrical connector comprising:

a main contact body;

a cantilevered portion extending upwardly from one end of said body, said cantilevered portion configured to receive a wire for electrical connection to the contact terminal;

a step portion extending upwardly from an end of said body opposite said cantilevered portion, said step portion being spaced away from said cantilevered portion a distance equal to a length of a stripped conductor of the wire received by the cantilevered portion;

a tongue portion connected to said step portion, said tongue portion being laterally spaced and substantially parallel with said main contact body; and a stiffener extending the entire length of said main contact body for providing rigidity to said main body, wherein said cantilevered portion extends from said main contact body at a junction thereof and said step portion extends from said main contact body at a junction thereof, said stiffener extending from said cantilevered portion juncture to said step portion juncture, and wherein said stiffener comprises two substantially parallel ribs extending from said cantilevered portion juncture to said step portion junction, and wherein said ribs are laterally spaced a distance equal to a diameter of a conductor of the wire received by the cantilevered portion, whereby said ribs are configured to receive the conductor therebetween.

23. A contact terminal as defined in claim 22, wherein said cantilevered portion includes a wire opening formed therethrough, said ribs being disposed on opposite sides of said wire opening.

24. An electrical connector comprising:

a contact terminal including a main contact body having an upper surface, a cantilevered portion extending upwardly from one end of said main contact body upper surface and a stiffener disposed on said upper surface of said contact body and extending the entire length of said main contact body upper surface for providing rigidity to said main contact body, said cantilevered portion being configured to receive a wire inserted therein in an insertion direction; and a housing defining a chamber for receiving said contact terminal, said housing including an internal ledge adjacent said chamber, said ledge preventing said cantilevered portion of said contact form bending in a direction opposite said wire insertion direction.

* * * * *